US012465161B2

(12) United States Patent
Gerkens

(10) Patent No.: US 12,465,161 B2
(45) Date of Patent: Nov. 11, 2025

(54) TRAY COMPRISING A CARDBOARD BASE FOR FOOD DISPLAY

(71) Applicant: Sabert Corporation, Sayreville, NJ (US)

(72) Inventor: Vincent Gerkens, Braine-l'Alleud (BE)

(73) Assignee: Sabert Corporation, Sayreville, NJ (US)

( * ) Notice: Subject to any disclaimer, the term of this patent is extended or adjusted under 35 U.S.C. 154(b) by 110 days.

(21) Appl. No.: 18/439,140

(22) Filed: Feb. 12, 2024

(65) Prior Publication Data

US 2024/0277170 A1 Aug. 22, 2024

(30) Foreign Application Priority Data

Feb. 17, 2023 (BE) ..... 2023/5122

(51) Int. Cl.
*A47G 23/06* (2006.01)

(52) U.S. Cl.
CPC ..... *A47G 23/06* (2013.01)

(58) Field of Classification Search
CPC ..... A47G 23/06
USPC ..... 206/557; 229/902, 904, 906, 117.16, 229/117.17
See application file for complete search history.

(56) References Cited

U.S. PATENT DOCUMENTS

| | | | | |
|---|---|---|---|---|
| 5,699,959 | A | 12/1997 | Huspeka et al. | |
| 2004/0256280 | A1* | 12/2004 | Meissen | B65D 11/10 206/557 |
| 2013/0118943 | A1* | 5/2013 | Furey | B65D 21/0231 206/427 |
| 2013/0236690 | A1* | 9/2013 | Babington | B65D 5/3657 428/157 |
| 2015/0321783 | A1* | 11/2015 | Kenner | B65D 5/445 206/557 |
| 2021/0371165 | A1* | 12/2021 | Liporazzi | B65D 25/16 |

FOREIGN PATENT DOCUMENTS

| | | |
|---|---|---|
| EP | 4071067 | 10/2022 |
| FR | 2656591 | 7/1991 |
| WO | WO 2014/009684 | 1/2014 |

OTHER PUBLICATIONS

Search Report dated Feb. 17, 2023 issued in Belgian Patent Application No. 202305122.

* cited by examiner

*Primary Examiner* — Jacob K Ackun
(74) *Attorney, Agent, or Firm* — COZEN O'CONNOR

(57) ABSTRACT

Tray (21) having a cardboard base (1) and at least a first wall (3*a*) and a second wall (3*b*) formed by a first layer and a second layer each having at least one hole (6), the second layer of the first wall having a first planar projection (12), forming an angle with the first wall of between 30° and 90° arranged to retain a first embossing of a lid, the second layer of the second wall having a second planar projection forming an angle with the second wall of between 30° and 90° to retain a second embossing of the lid.

20 Claims, 4 Drawing Sheets

TRAY COMPRISING A CARDBOARD BASE FOR FOOD DISPLAY

BACKGROUND OF THE INVENTION

1. Field of the Invention

The present invention relates to a tray comprising a cardboard base arranged to be engaged with a lid. The present invention also relates to a tray and lid assembly, to the tray blank and to the manufacturing method.

2. Description of the Related Art

For the purposes of the present invention, the term "tray" means a tray, container, receptacle or dish intended to contain a typical food product, these terms being used interchangeably herein.

There is packaging for displaying salads or ready meals, typically with transparent plastic lids. It has the advantage of showing consumers the dish they can buy at the counter. Often, these dishes or trays are made of black or transparent plastic and are then engaged with a lid that is also made of plastic, such as PP or transparent PET.

However, the trend in the food sector is to reduce the amount of plastic and replace it with cardboard or cellulose-based materials, such as fibres from paper or sugar cane, in order to decrease the consumption of disposable plastic products.

Therefore, for the purposes of the present invention, the term "cardboard" means a material formed from a cellulose or lignocellulose base, such as cardboard, for example, but also Stora Enso CKB 250-gram cardboard.

The existing dishes or trays offered numerous advantages, and given that this was a mature product, they were remarkably well designed to satisfy both the consumer in the use thereof and the caterer or manufacturer who filled them. These plastic containers, for example, are easy to stack, both when empty and full, with their lids on, and are strong enough not to crush the food product. Furthermore, the lid is typically clipped on to sufficiently protect the contents of the container, but also so that it can be easily opened by the consumer.

There have been several attempts to replace these plastic containers with cardboard containers, but the products currently being developed are still immature. They are often complex to manufacture and assemble or they cannot be stacked full or stacked empty. In other cases, it is the lids that do not fit tightly enough because the strength of cardboard and plastic is different, or the lids fit too tightly and the container is very difficult to open because, for the lids to fit, the interlocking is important, but the low strength of the cardboard walls makes it complicated to open without spilling the contents of the tray out of its container or because of the lack of grip achievable in the cardboard container.

SUMMARY OF THE INVENTION

A purpose of the present invention is to overcome the disadvantages of the prior art by providing a tray that is as easy to use as a plastic container, but with a cardboard base. More particularly, an embodiment of the present invention provides a tray comprising a cardboard base that is easy to stack when empty and easy to stack once full, and provided a lid that is easy to close and remains closed when restocked on the shelves, is sufficiently strong but also easy to open for the consumer of the contents of the tray.

To solve this problem, an embodiment of the invention provides a tray comprising a cardboard base arranged to engage a lid, said base comprising a basal wall provided with at least three walls which extend predominantly upwards from the basal wall, at least a first wall and a second wall of the three walls being formed of a first layer of cardboard and a second layer of cardboard, said first layer of cardboard facing the inside of the tray and said second layer of cardboard facing the outside of said tray, said second layer of said first wall and of said second wall comprising at least a first longitudinal through hole and a second longitudinal through hole respectively, said first longitudinal through hole of the first wall being delimited by the cardboard of the second layer of the first wall forming at least a top edge and a bottom edge between which the first hole is located, said top edge being positioned at a distance H1 measured from a horizontal plane passing through a straight portion of an upper edge of said first wall and along the height of said first wall, and said second longitudinal through hole of the second layer of the second wall being delimited by the cardboard of the second wall forming at least a top edge and a bottom edge between which the second hole is located, said top edge being positioned at a distance H2 measured from a horizontal plane passing through a straight portion of an upper edge of said second wall and along the height of said second wall, said second layer of said first wall having a first substantially planar projection positioned above said first hole, having a height h1, measured between said top edge and a fold line predominantly forming said upper edge of said first wall, measured along the height of said projection, said height h1 being greater than said height H1, said first projection forming an angle with said first wall of less than or equal to 90° and greater than 30° arranged to retain a first embossing present on an inner surface of a first downwardly extending side wall of a cover wall of a lid, said second layer of said second wall having a second substantially planar projection, positioned above said second longitudinal through hole, having a height h2, measured between said top edge and a fold line predominantly forming said upper edge of said second wall, measured along the height of said projection, said height h2 being greater than said height H2, said second projection forming an angle with said second wall of less than or equal to 90° and greater than 30° arranged to retain a second embossing present on an inner surface of a second downwardly extending side wall of a cover wall of a lid.

As can be seen, the described tray has a first and a second substantially planar projection formed during the folding of the side walls thanks to a deflection of the grooved, kiss-cut or perforated folding line, under which projections there are respectively a first and a second hole formed in the second layer of each of the first and second walls. These two projections, on two different walls, together with the two holes, each enable an embossing provided in a lid to be engaged and firmly retained. The tray thus formed is also stackable when empty, as the projections prevent the trays from sinking into each other when they are stacked and also make it easier to separate them for filling. Furthermore, there are no obstacles inside or outside the tray to prevent it from being separated when stacked. The fact that the side walls have a double layer also strengthens the tray, which enables stacking when it is full, but also makes it easier to open because the side walls do not collapse under the pressure of the consumer who wants to eat. The presence of this double layer, where a hole is made in one layer under the projections, strengthens the grip of the lid, and the food remains isolated from the environment outside the tray, since the other layer keeps the product isolated from the outside environment and therefore from potential contamination.

For the purposes of the present invention, the deflection of the folding line may comprise a succession of straight segments or a curve. Similarly, the hole may be oblong, oval, rectangular, hexagonal, half-moon-shaped or even comprising one or more rounded edges and/or one or more straight edges.

For the purposes of the present invention, the term "basal wall provided with at least three walls which extend predominantly upwards from the basal wall" means that said at least three walls extend upwards transversally relative to the basal wall, either perpendicularly or in a slightly flared manner to make it easier to stack several empty trays one inside the other.

Preferably, said at least three walls extend upwards transversally relative to the basal wall in a slightly flared manner. In this case, the angle formed between the first projection and the first wall, or the angle formed between the second projection and the second wall, may even be up to 90° without preventing the lid from snapping into place. The upper wall of the first and second substantially planar projections formed during the folding of the side walls are thus oriented downwards and enable the embossings of the lid to be guided until they reach a closed position in which the lid has the embossings engaged under the projections that retain it, in the holes. The downwards orientation of the upper wall of the first and second substantially planar projections enable the embossings to slide along the wall when the user applies pressure on the lid to engage it with the tray.

Advantageously, said basal wall provided with at least three walls is a basal wall provided with 3, 4, 6, 8, 10 or 12 walls.

As can be seen, the tray according to the present invention may be triangular, rectangular or square, in the shape of a hexagon, octagon, decagon, dodecagon, etc.

Preferably, according to the present invention, the tray is rectangular or square, said basal wall thus being provided with 4 walls and said first wall and said second wall face each other, as do the third and the fourth.

In an advantageous embodiment of the present invention, said second layer of said first wall has a third longitudinal through hole delimited by the cardboard of the second layer of the first wall forming at least a top edge and a bottom edge between which the third hole is located, said top edge being positioned at a distance H3 measured from a horizontal plane passing through a straight portion of an upper edge of said first wall and along the height of said first wall, said second layer of said first wall having a third substantially planar projection, positioned above said third hole, having a height h3, measured between said top edge and a fold line predominantly forming said upper edge of said first wall, measured along the height of said third projection, said height h3 being greater than said height H3, said third projection forming an angle with said first wall of less than or equal to 90° and greater than 30°.

Therefore, the tray according to the present invention comprises two projections as well as two holes on one of the side walls in order to strengthen the hold of the lid, which is particularly advantageous for relatively long trays.

In yet another preferential embodiment according to the present invention, said second layer of said second wall has a fourth longitudinal through hole delimited by the cardboard of the second layer of the second wall forming at least a top edge and a bottom edge between which the fourth hole is located, said top edge being positioned at a distance H4 measured from a horizontal plane passing through a straight portion of an upper edge of said first wall and along the height of said first wall, said second layer of said second wall having a fourth substantially planar projection, positioned above said fourth longitudinal through hole, having a height h4, measured between said top edge and a fold line predominantly forming said upper edge of said second wall, measured along the height of said fourth projection, said height h4 being greater than said height H4, said fourth projection forming an angle with said second wall of less than or equal to 90° and greater than 30°.

Therefore, the tray according to the present invention comprises two projections as well as two holes on two of the side walls, preferably on opposite side walls in order to strengthen the hold of the lid, which is particularly advantageous for relatively long trays.

Preferably, according to the present invention, said first wall and said second wall respectively have a first and a second length, and wherein said first longitudinal through hole of the first wall has a first length and said second longitudinal through hole of the second wall has a second length, said tray being characterised in that the proportion between the first length of said first wall and the first length of said first longitudinal through hole present on the first wall is between 5 and 30, preferably between 7 and 25, preferably between 8 and 15, preferably between 9 and 12, more particularly between 9.8 and 10.8, and in that the proportion between the second length of said second wall and the second length of said second longitudinal hole present on the second wall is between 5 and 30, preferably between 7 and 25, preferably between 8 and 15, preferably between 9 and 12, more particularly between 9.8 and 10.8.

In a particular embodiment of the present invention, said first wall and said second wall respectively have a first and a second length, and wherein said third longitudinal through hole of the first wall has a third length and said fourth longitudinal through hole of the second wall has a fourth length, said tray being characterised in that the proportion between the first length of said first wall and the third length of said third longitudinal through hole present on the first wall is between 5 and 30, preferably between 7 and 25, preferably between 8 and 15, preferably between 9 and 12, more particularly between 9.8 and 10.8, and in that the proportion between the second length of said second wall and the fourth length of said fourth longitudinal hole present on the second wall is between 5 and 30, preferably between 7 and 25, preferably between 8 and 15, preferably between 9 and 12, more particularly between 9.8 and 10.8.

In an advantageous embodiment according to the present invention, the upper edge of said first wall has at least a first inner deflection forming the top edge of said first projection.

In another advantageous embodiment according to the present invention, the upper edge of said second wall has at least a second inner deflection forming the top edge of said second projection.

In another advantageous embodiment according to the present invention, the upper edge of said first wall has at least a third inner deflection forming the top edge of said third projection.

In another advantageous embodiment according to the present invention, the upper edge of said second wall has at least a fourth inner deflection forming the top edge of said fourth projection.

For the purposes of the present invention, the term "inner deflection" means the folding line is deflected towards the inside of the tray.

Other embodiments of the tray according to the present invention are mentioned in the appended claims.

The present invention also relates to an assembly formed by a tray according to the invention, further comprising a lid formed by a cover wall from which at least three side walls extend downwards, including the first and second side wall, said first side wall and said second side wall each having an inner surface respectively provided with a first and a second embossing projecting towards the inside of said lid arranged to fit respectively under the first projection of the first wall of the tray and under the second projection of the second wall of the tray.

More particularly, the lid is formed by a cover wall from which four side walls extend downwards, facing each other in pairs. Preferably, the first and second embossings are present on the first side wall and the second side wall facing the first side wall.

In a particular embodiment of the assembly according to the present invention, the projections create a guide wall for the lid, making it easier to slide the embossings along the substantially planar upper wall of the projections, to interlock them under the corresponding projections and to retain the embossings in the holes under the projections.

In a particular embodiment of the assembly according to the present invention, the first and second side walls have a shoulder, so that the cover wall has a smaller section than the section of the basal portion of the tray. Therefore, the lid has a cross-section that enlarges towards the bottom, and the shoulder creates a rim that is arranged to rest on the edges of the side walls of the tray, enabling it to rest on an area of the tray that is resistant to collapse. The embossings on the first and second side walls of the lid, beyond the rim formed by the shoulder starting from the cover wall, are then made in the lid portion which surrounds the side walls of the tray, so as to cooperate with the projections present on the outside of the first and second walls of the tray and to be placed in the first and second holes therein.

More particularly, according to the present invention, said first embossing has a depth P1 of between 0.8 and 5 mm, preferably between 1 and 3 mm, preferably 2 mm, and wherein said second embossing has a depth P2 of between 0.8 and 5 mm, preferably between 1 and 3 mm, preferably 2 mm.

When the tray comprises a first and a third projection on the first wall and a second and a fourth projection on the second wall, as well as a first and a third hole on the first wall and a second and a fourth hole on the second wall, the lid comprises a first and a third embossing on the first wall and a second and a fourth embossing on the second wall.

Advantageously, in this case, said third embossing has a depth P3 of between 0.8 and 5 mm, preferably between 1 and 3 mm, preferably 2 mm, and the fourth embossing has a depth P4 of between 0.8 and 5 mm, preferably between 1 and 3 mm, preferably 2 mm.

Other embodiments of the assembly according to the present invention are mentioned in the appended claims.

The present invention also relates to a blank of a cardboard tray having a basal section provided with at least three sides, including at least a first and a second side, a first section of first wall adjacent to the basal section, along said first side, a second section of first wall adjacent to the first section of first wall, a first fold line comprising at least a straight portion, arranged to form an upper edge of said first wall of said tray, said second section of said first wall having a first longitudinal recess of length L1, arranged to form a first hole of the first wall, said first fold line further having a first deflection in said first section of first wall, the length of which is greater than the length L1, and a first section of second wall adjacent to the basal section, along said second side, a second section of second wall adjacent to the first section of second wall, a second fold line comprising at least a straight portion, arranged to form an upper edge of said second wall of said tray, said second section of said second wall having a second longitudinal recess of length L2, arranged to form a second hole of the second wall, said second fold line further having a second deflection in said first section of second wall, the length of which is greater than the length L2, said sides of said basal section being fold lines formed by grooving and/or scoring and/or kiss-cutting of the cardboard.

In a preferential embodiment according to the present invention, the blank of a cardboard tray further comprises a first section of third wall adjacent to the basal section, along a third side, a second section of third wall adjacent to the first section of third wall, a third fold line between the first and the second section of third wall, arranged to form an upper edge of a third wall of said tray, said second section of third wall having an edge opposite the third fold line and a first and a second transverse edge facing each other, the blank further comprising a first tab section extending from said first transverse edge and a second tab section extending from said second transverse edge of the second section of the third wall, said first tab section having a linked edge and a free edge, said linked edge being connected to said first transverse edge of the second section of the third wall and forming a fold line, formed by grooving and/or scoring and/or kiss-cutting, said first tab section further having a third edge and a fourth edge, said third edge and said fourth edge being spaced apart by a distance D1 along the linked edge and by a distance D2 along the free edge, the distance D1 being greater than the distance D2, said first tab section being arranged to be introduced between the first section and the second section of the first wall, said second tab section having a linked edge and a free edge, said linked edge being connected to said second transverse edge of the second section of the third wall and forming a fold line, formed by grooving and/or scoring and/or kiss-cutting, said second tab section further having a third edge and a fourth edge, said third edge and said fourth edge being spaced apart by a distance D3 along the linked edge and by a distance D4 along the free edge, the distance D3 being greater than the distance D4, said second tab section being arranged to be introduced between the first section and the second section of the second wall.

More particularly, the blank of a cardboard tray according to the present invention comprises a basal section which comprises 4 sides, said first and second sides being opposite each other and comprising a fourth side opposite to the third side, said blank further comprising a first section of fourth wall adjacent to the basal section, along a fourth side, a second section of fourth wall adjacent to the first section of fourth wall, a fourth fold line between the first and the second section of fourth wall, arranged to form an upper edge of a fourth wall of said tray, said second section of fourth wall having an edge opposite the fourth fold line and a first and a second transverse edge facing each other, the blank further comprising a third tab section extending from said first transverse edge and a fourth tab section extending from said second transverse edge of the second section of the fourth wall, said third tab section having a linked edge and a free edge, said linked edge being connected to said first transverse edge of the second section of the fourth wall and forming a fold line, formed by grooving and/or scoring and/or kiss-cutting, said third tab section further having a third edge and a fourth edge, said third edge and said fourth edge being spaced apart by a distance D5 along the linked edge and by a distance D6 along the free edge, the distance D5 being greater than the distance D6, said third tab section being arranged to be introduced between the first section and the second section of the first wall, said fourth tab section having a linked edge and a free edge, said linked edge being connected to said second transverse edge of the second section of the fourth wall and forming a fold line, formed by grooving and/or scoring and/or kiss-cutting, said fourth tab section further having a third edge and a fourth edge, said third edge and said fourth edge being spaced apart by a distance D7 along the linked edge and by a distance D8 along the free edge, the distance D7 being greater than the distance D8, said fourth tab section being arranged to be introduced between the first section and the second section of the second wall.

In an advantageous variant, the basal section of the blank according to the present invention comprises 4 sides, said first and second sides being opposite each other and comprising a fourth side opposite a third side, the blank comprising a first section of third wall adjacent to the basal section, along a third side, a second section of third wall adjacent to the first section of third wall, a third fold line between the first and the second section of third wall, arranged to form an upper edge of a third wall of said tray, said second section of third wall having an edge opposite the third fold line and a first and a second transverse edge facing each other, said blank further comprising a first section of fourth wall adjacent to the basal section, along a fourth side, a second section of fourth wall adjacent to the first section of fourth wall, a fourth fold line between the first and second section of fourth wall, arranged to form an upper edge of a fourth wall of said tray, said second section of fourth wall having an edge opposite the fourth fold line and a first and second transverse edge facing each other, the blank further comprising a first section of securing means, for example a first bellows section, between the first section of the first wall and the first section of the fourth wall, a second section of securing means, for example a second bellows section, between the first section of the first wall and the first section of the third wall, a third section of securing means, for example a third bellows section, between the first section of the second wall and the first section of the fourth wall, and a fourth section of securing means, for example a fourth bellows section, between the first section of the second wall and the first section of the third wall.

In an advantageous variant of the present invention, said first deflection has a first segment extending from the first fold line towards the basal section, a second segment substantially parallel to the first fold line and a third segment extending from the second segment and joining the first fold line.

In another advantageous variant of the present invention, said second deflection has a first segment extending from the second fold line towards the basal section, a second segment substantially parallel to the second fold line and a third segment extending from the second segment and joining the second fold line.

In yet another advantageous variant of the present invention, said third deflection has a first segment extending from the first fold line towards the basal section, a second segment substantially parallel to the first fold line and a third segment extending from the second segment and joining the first fold line.

In yet another advantageous variant of the present invention, said fourth deflection has a first segment extending from the second fold line towards the basal section, a second segment substantially parallel to the second fold line and a third segment extending from the second segment and joining the second fold line.

More particularly, in the blank according to the present invention, said first fold line has a guideline passing through the straight portion of the first fold line and wherein said first recess has a point closest to said guideline, the distance between the closest point and said guideline, measured transversally along said second section of first wall, is H1, whereas the distance between the same point closest to the guideline of said first recess and the furthest point of the deflection is h1 and is greater than H1.

Preferentially, in the blank according to the present invention, said second fold line has a guideline passing through the straight portion of the second fold line and wherein said second recess has a point closest to said guideline, the distance between the closest point and said guideline, measured transversally along said second section of second wall, is H2, whereas the distance between the same point closest to the guideline of said second recess and the furthest point of the deflection is h2 and is greater than H2.

Advantageously, said second section of said first wall has a third longitudinal recess of length L3, arranged to form a third hole of the first wall, said first fold line further having a third deflection in said first section of first wall, the length of which is greater than the length L3.

Also advantageously, said second section of said second wall has a fourth longitudinal recess of length L4, arranged to form a fourth hole of the second wall, said second fold line further having a fourth deflection in said first section of second wall, the length of which is greater than the length L4.

Other embodiments of the tray blank according to the present invention are mentioned in the appended claims.

The present invention also relates to a method for manufacturing a cardboard tray according to the invention, comprising the steps of:

- cutting a blank according to the invention
- making folding lines in the basal section by grooving and/or scoring and/or kiss-cutting along said at least three sides, preferably along said at least 4 sides,
- making said first, second and third folding lines, preferably making said first, second, third and fourth folding lines, by grooving and/or scoring and/or kiss-cutting,
- gluing on the reverse side of the first section and/or the second section of each of the first, second and third walls, preferably gluing on the reverse side of the first section and/or the second section of each of the first, second, third and fourth walls,
- folding the first section onto the second section of each of the first, second and third walls, preferably folding the first section onto the second section of each of the first, second, third and fourth walls,
- placing in a tray forming machine to straighten said first, second and third walls, preferably each of the first, second, third and fourth walls upwards,
- assembling the third wall to the first and second walls, preferably the third wall to the first and second walls and the fourth wall to the first and second walls, by hemming the first tab section of the third wall, and preferably also of the fourth wall, so as to bring the first tab section into contact with the first or second section of the first wall and hemming the second tab section of the third wall, preferably also of the fourth wall, so as to bring the second tab section into contact with the first or the second section of the second wall, or by folding and optionally gluing, when a fourth wall is present, said first, second, third and fourth securing means.

Preferentially, for the purposes of the present invention, bringing the first tab section of the third wall, preferably also of the fourth wall, into contact with the first or second section of the first wall means inserting the first tab section of the third wall, preferably also of the fourth wall, between the first and second section of the first wall.

Preferentially, for the purposes of the present invention, bringing the second tab section of the third wall, preferably also of the fourth wall, into contact with the first or second section of the first wall means inserting the second tab section of the third wall, preferably also of the fourth wall, between the first and second section of the first wall. The first and second tab section of the third wall, preferably also of the fourth wall, are thus made integral with the first wall, because the first and second tab section are introduced into a space between the first and second sections of first wall, either by interlocking or by gluing using the adhesive introduced at the time of gluing on the reverse side of the first section and/or the second section of each of the first, second, or by introducing additional adhesive during an additional gluing step.

Alternatively, the walls of the tray are secured by folding and optionally gluing, when a fourth wall is present, said first, second, third and fourth securing means.

Thus, the first section of securing means, for example the first bellows section, is folded and optionally glued to the inner surface or the outer surface of the first wall or the fourth wall, the second section of securing means, for example the second bellows section, is folded and optionally glued to the inner surface or the outer surface of the first wall or the third wall, the third section of securing means, for example the third bellows section, is folded and optionally glued to the inner surface or the outer surface of the second wall or the fourth wall, and the fourth section of securing means, for example the fourth bellows section, is folded and optionally glued to the inner surface or the outer surface of the second wall or the third wall.

Another example of a section of securing means may be a tab section that extends not from the second sections of first, second, third and optionally fourth walls, but rather from the first sections of first, second, third and optionally fourth walls, for example when the first and second sections of first, second, third and optionally fourth walls are not the same height and only partially overlap.

Other embodiments of the method according to the invention are mentioned in the appended claims.

Other features, details and advantages of the invention will emerge from the description given below, which is non-limiting and refers to the drawings and examples.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

In the figures, the same or like items bear the same references.

Figure 1:
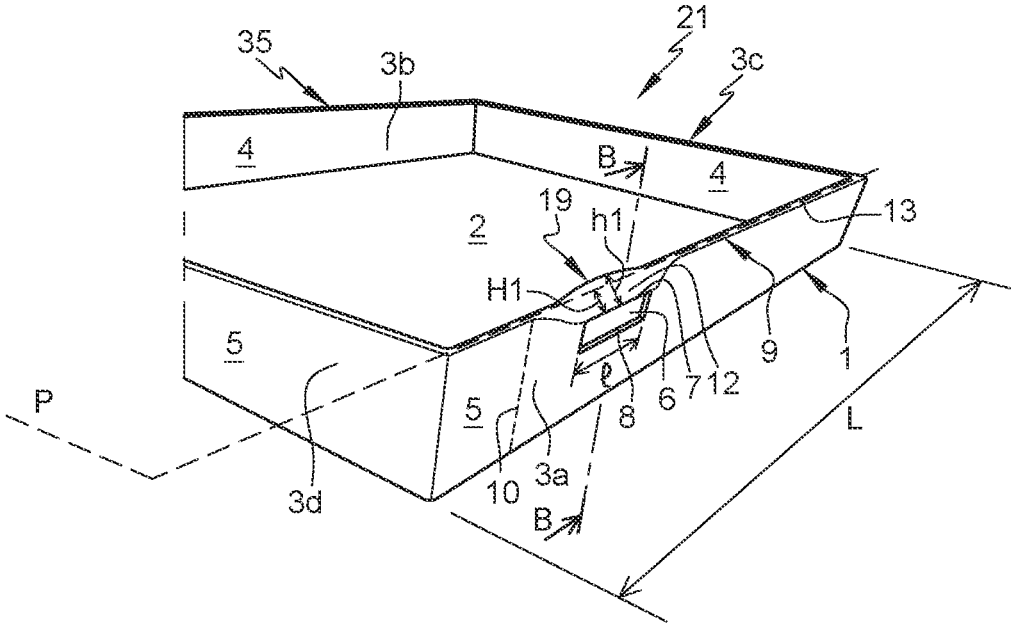
FIG. 1 is a perspective view of the cardboard tray according to the present invention.
Figure 2:
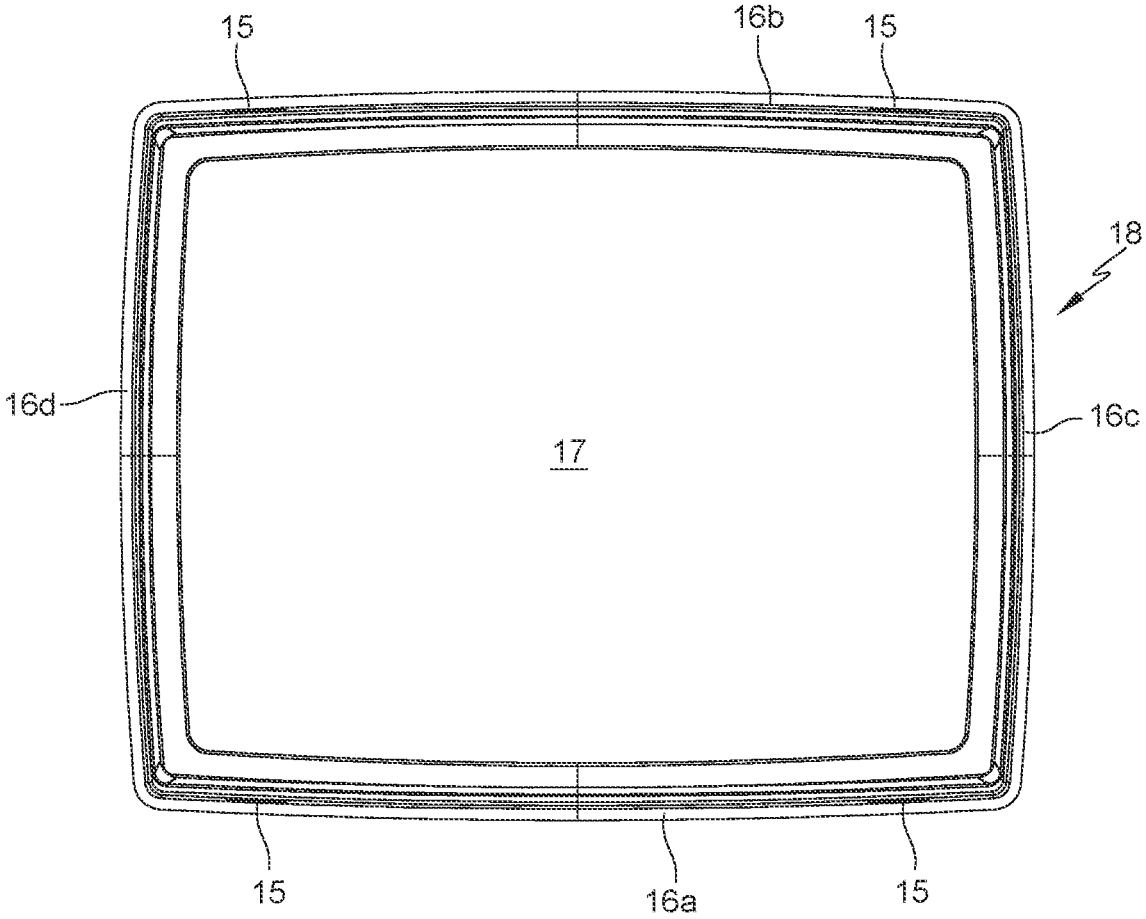
FIG. 2 is a top view of the lid of the assembly according to the present invention.
Figure 3:
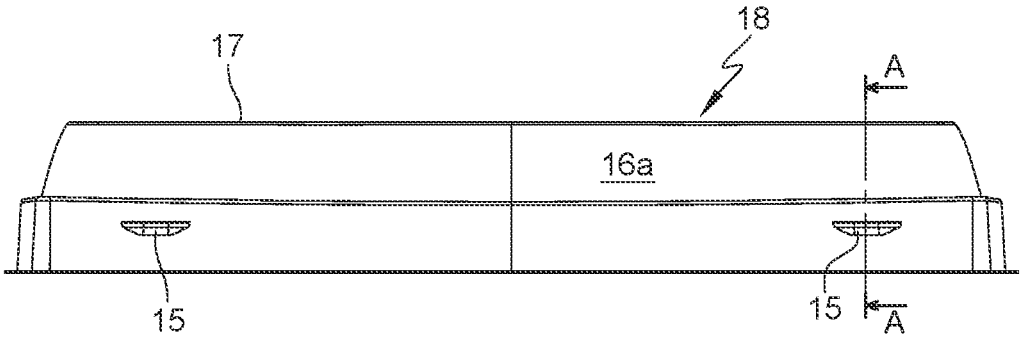
FIG. 3 is a side view of the lid of the assembly according to the present invention.
Figure 4:
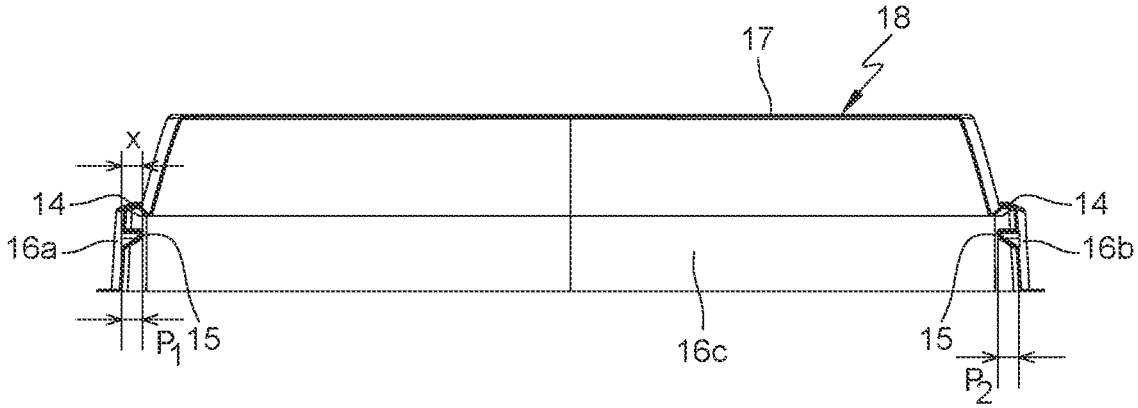
FIG. 4 is a cross-sectional view along the line A-A shown in FIG. 3 of the lid of the assembly according to the present invention.
Figure 5:
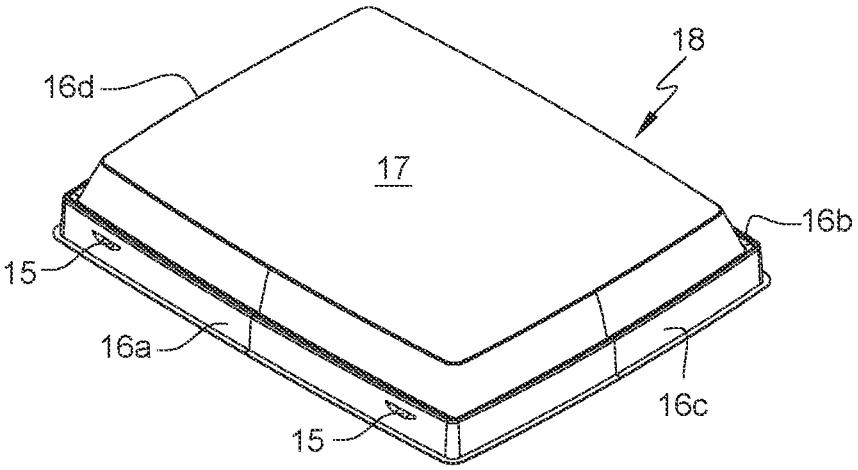
FIG. 5 is a perspective view of the lid according to the present invention.

As can be seen in FIG. 1, the tray according to the present invention comprises a cardboard base 1 arranged to engage a lid (not shown). The base 1 comprises a basal wall 2 provided with four walls 3*a*, 3*b*, 3*c*, 3*d* which extend predominantly upwards from the basal wall 2.

In the embodiment shown in FIG. 1, all the walls 3*a*, 3*b*, 3*c*, 3*d* are formed by a first layer 4 of cardboard and a second layer 5 of cardboard. However, it is only required that at least the first wall and the second wall are formed by a first layer of cardboard and a second layer of cardboard.

The first layer 4 of cardboard faces the inside of the tray and said second layer 5 of cardboard is facing the outside of said tray. The second layer 5 of said first wall 3*a* and said second wall 3*b* comprises at least a first longitudinal through hole 6 and a second longitudinal through hole (not visible), respectively. The first longitudinal through hole 6 of the first wall 3*a* is delimited by the cardboard of the second layer 5 of the first wall 3*a* forming at least one top edge 7 and one bottom edge 8 between which the first hole 6 is located. Said top edge 7 is positioned at a distance H1 measured from a horizontal plane P passing through a straight portion of an upper edge 9 of said first wall 3*a* and along the height 10 of said first wall 3*a*.

The second longitudinal through hole of the second layer 5 of the second wall 3*b* is delimited by the cardboard of the second wall 3*b* forming at least one top edge and one bottom edge between which the second hole is located. The top edge (not shown) is positioned at a distance H2 measured from a horizontal plane passing through a straight portion of an upper edge of said second wall 3*b* and along the height 11 of said second wall 3*b*. The second layer 5 of said first wall 3*a* has a first substantially planar projection 12, positioned above said first hole 6, having a height h1, measured between said top edge 7 and a fold line 13 predominantly forming said upper edge 9 of said first wall 3*a* measured along the height of said projection 12.

Figure 8:
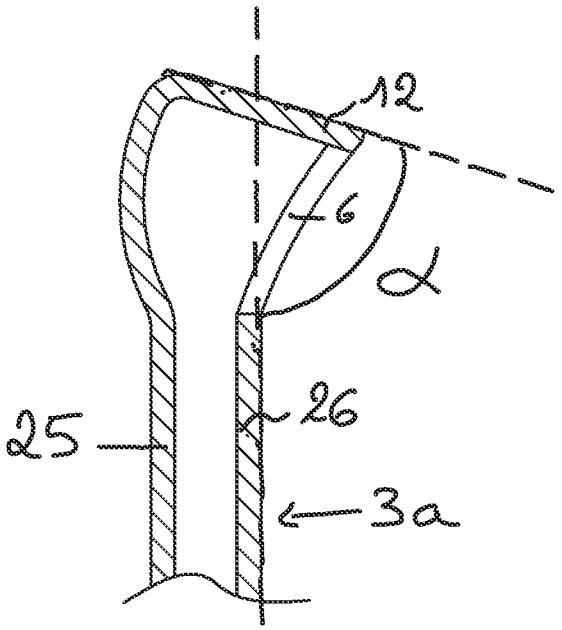
FIG. 8 is a cross-sectional view along a cross-sectional line of the first wall, taken from the middle of the first projection 12.

The height h1 is greater than said height H1. The first projection 12 forming an angle $\alpha$ (see FIG. 8) with said first wall 3*a* of less than or equal to 90° and greater than 30° is arranged to retain a first embossing 15 (see FIGS. 2, 3, 4 and 5) present on an inner surface of a first downwardly extending side wall 16*a* of a cover wall 17 of a lid 18.

The second layer 5 of said second wall 3*b* has a second substantially planar projection (not visible) which is positioned above said second longitudinal through hole (not visible), having a height h2, measured between said top edge and a fold line predominantly forming said upper edge of said second wall, measured along the height of said projection. The height h2 is greater than said height H2, said second projection forming an angle with said second wall of less than or equal to 90° and greater than 30°, arranged to retain a second embossing 15 present on an inner surface of a second downwardly extending side wall 16*b* of a cover wall 17 of a lid 18.

Preferably, according to the present invention, said first wall 3*a* and said second wall 3*b* respectively have a first and a second length L, and wherein said first longitudinal through hole 6 of the first wall 3*a* has a first length l and said second longitudinal through hole of the second wall 3*b* has a second length l, said tray being characterised in that the proportion between the first length L of said first wall 3*a* and the first length l of said first longitudinal through hole 6 present on the first wall 3*a* is between 9 and 11, preferably between 9.5 and 10.5, more particularly between 9.8 and 10.2 and in that the proportion between the second length L of said second wall 3*b* and the second length l of said second longitudinal through hole present on the second wall 3*b* is between 9 and 11, preferably between 9.5 and 10.5, more particularly between 9.8 and 10.2.

According to the present invention, the upper edge 9 of said first wall 3*a* has at least a first inner deflection 19 forming the top edge of said first projection 12.

As can be seen in FIGS. 2, 3, 4 and 5, the lid 18 is formed by a cover wall 17 from which four side walls 16*a*, 16*b*, 16*c*, 16*d* extend downwards, facing each other in pairs, said first side wall 16*a* and said second side wall 16*b* each having an inner surface respectively provided with a first and a second embossing 15 projecting towards the inside of said lid 18 arranged to fit respectively under the first projection 12 of the first wall 3*a* of the tray and under the second projection of the second wall of the tray.

At least the first 16*a* and second side walls 16*b* have a shoulder 14 of a width x, so that the cover wall 17 has a smaller section than the section of basal wall 2 of the tray. Therefore, the lid 18 has a cross-section that enlarges towards the bottom, and the shoulder 14 creates a rim that is arranged to rest on the edges 9 of the side walls of the tray, enabling it to rest on an area of the tray that is resistant to collapse. The embossings 15 on the first and second side walls of the lid 16*a*, 16*b*, beyond the rim formed by the shoulder 14 starting from the cover wall 17, are then made in the lid portion which surrounds the side walls of the tray.

More particularly, according to the present invention, said first embossing has a depth P1 of between 0.8 and 5 mm, preferably between 1 and 3 mm, preferably 2 mm, and wherein said second embossing has a depth P2 of between 0.8 and 5 mm, preferably between 1 and 3 mm, preferably 2 mm.

Figure 6:
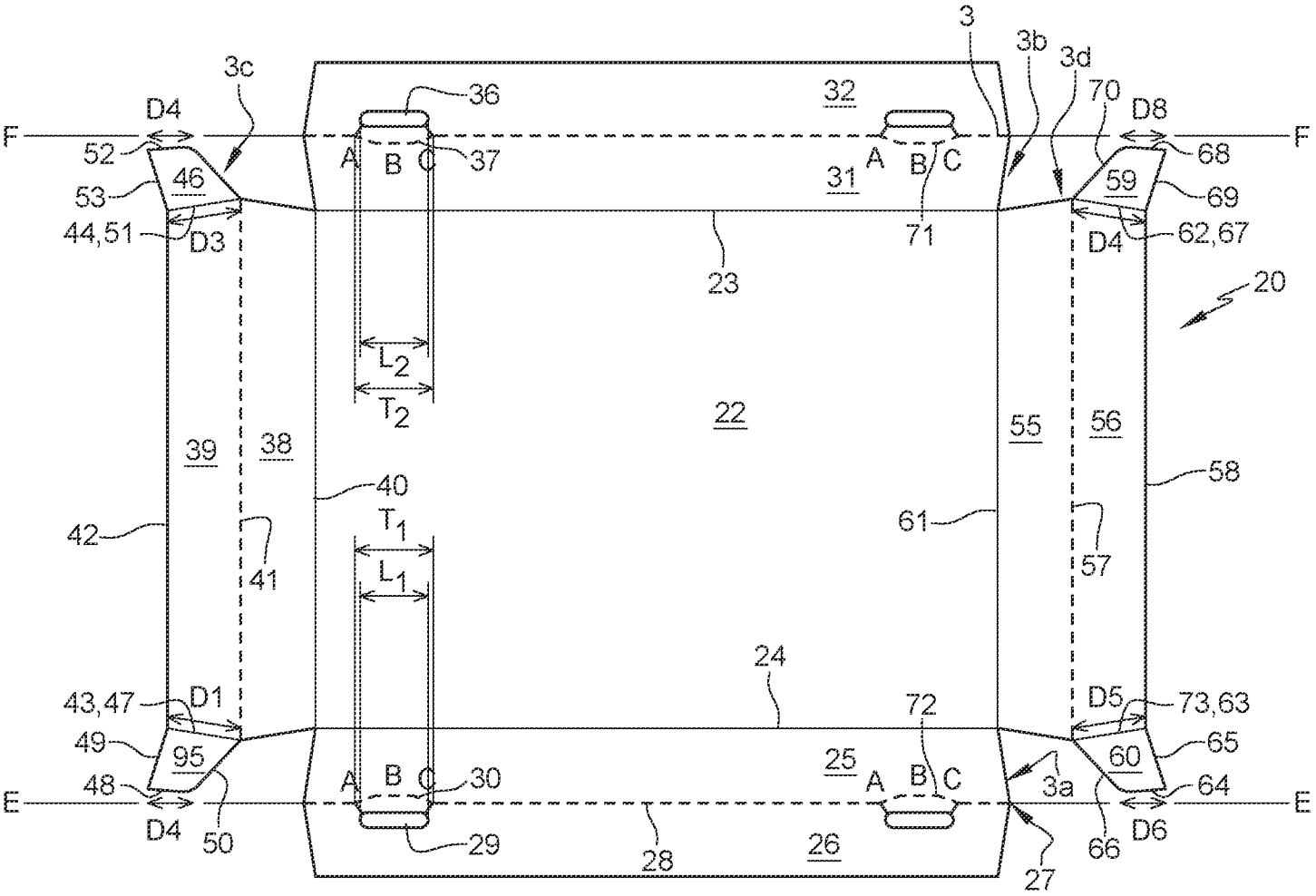
FIG. 6 is a top view of the tray blank according to the present invention.

FIG. 6 shows the blank 20 of a cardboard tray 21 having a basal section 22 provided with at least a first 24 and a second side 23, a first section 25 of first wall 3*a* adjacent to the basal section 22, along said first edge 24, a second section 26 of first wall 3*a* adjacent to the first section 25 of first wall 3*a*, a first fold line 27 comprising at least one straight portion 28, arranged to form an upper edge 9 of said first wall 3*a* of said tray 21.

The second section 26 of said first wall 3*a* having a first longitudinal recess 29 of length L1, arranged to form the first hole 6 of the first wall 3*a*, said first fold line 27 further having a first deflection 30 in said first section 25 of first wall 3*a*, the length T1 of which is greater than the length L1, and a first section 31 of second wall 3*b* adjacent to the basal section 22, along said second side 23, a second section 32 of second wall 3*b* adjacent to the first section 31 of second wall 3*b*, a second fold line 33 comprising at least one straight portion 34, arranged to form an upper edge 35 of said second wall 3*b* of said tray 21.

The second section 32 of said second wall 3*b* having a second longitudinal recess 36 of length L2, arranged to form a second hole of the second wall 3*b*, said second fold line 33 further having a second deflection 37 in said first section 31 of second wall 3*b*, the length T2 of which is greater than the length L2, said sides 23, 24 of said basal section 22 being fold lines formed by grooving and/or scoring and/or kiss-cutting of the cardboard.

The blank 20 of a cardboard tray 21 further comprises a first section 38 of third wall 3*c* adjacent to the basal section 22, along a third side 40, a second section 39 of third wall 3*c* adjacent to the first section 38 of third wall 3*c*, a third fold line 41 between the first 38 and the second 39 section of third wall 3*c*, arranged to form an upper edge of a third wall 3*c* of said tray 21.

The second section 39 of third wall 3*c* has an edge 42 opposite the third fold line 41 and a first 43 and a second transverse edge 44 facing each other. The blank further comprises a first tab section 45 extending from said first transverse edge 43 and a second tab section 46 extending from said second transverse edge 44 of the second section 39 of the third wall 3*c*.

The first tab section 45 has a linked edge 47 and a free edge 48, said linked edge 47 being connected to said first transverse edge 43 of the second section 39 of the third wall 3*c* and forming a fold line, formed by grooving and/or scoring and/or kiss-cutting.

The first tab section 45 further has a third edge 49 and a fourth edge 50, said third edge 49 and said fourth edge 50 being spaced apart by a distance D1 along the linked edge and by a distance D2 along the free edge, the distance D1 being greater than the distance D2, said first tab section 45 being arranged to be introduced between the first section 25 and the second section 26 of the first wall 3*a*.

The second tab section 46 has a linked edge 51 and a free edge 52, said linked edge 51 being connected to said second transverse edge 44 of the second section 39 of the third wall 3*c* and forming a fold line, formed by grooving and/or scoring and/or kiss-cutting.

The second tab section 46 further has a third edge 53 and a fourth edge 54, said third edge 53 and said fourth edge 54 being spaced apart by a distance D3 along the linked edge 51 and by a distance D4 along the free edge 52, the distance D3 being greater than the distance D4, said second tab section 46 being arranged to be introduced between the first section 31 and the second section 32 of the second wall 3*b*.

The blank 21 of a cardboard tray according to the present invention further comprises a first section 55 of fourth wall 3*d* adjacent to the basal section 22, along a fourth side 61, a second section 56 of fourth wall 3*d* adjacent to the first section 55 of fourth wall 3*d*, a fourth fold line 57 between the first 55 and the second section 56 of fourth wall 3*d*, arranged to form an upper edge of a fourth wall 3*d* of said tray 21.

The second section 56 of fourth wall 3*d* has an edge 58 opposite the fourth fold line 57 and a first 73 and a second transverse edge 62 facing each other. The blank further comprises a third tab section 60 extending from said first transverse edge 73 and a fourth tab section 59 extending from said second transverse edge 62 of the second section 56 of the fourth wall 3*d*.

The third tab section 60 has a linked edge 63 and a free edge 64, said linked edge 63 being connected to said first transverse edge 73 of the second section 56 of the fourth wall 3*d* and forming a fold line, formed by grooving and/or scoring and/or kiss-cutting.

The third tab section 60 further has a third edge 65 and a fourth edge 66, said third edge 65 and said fourth edge 66 being spaced apart by a distance D5 along the linked edge and by a distance D6 along the free edge, the distance D5 being greater than the distance D6, said third tab section 60 being arranged to be introduced between the first section 25 and the second section 26 of the first wall 3*a*.

The fourth tab section 59 has a linked edge 67 and a free edge 68, said linked edge 67 being connected to said second transverse edge 62 of the second section 56 of the fourth wall 3*d* and forming a fold line, formed by grooving and/or scoring and/or kiss-cutting.

The fourth tab section 59 further has a third edge 69 and a fourth edge 70, said third edge 69 and said fourth edge 70 being spaced apart by a distance D7 along the linked edge 67 and by a distance D8 along the free edge 68, the distance D7 being greater than the distance D8.

The fourth tab section 59 is arranged to be introduced between the first section 31 and the second section 32 of the second wall 3*b*.

The first deflection 30 has a first segment A extending from the first fold line 27 of the basal section 22, a second segment B substantially parallel to the first fold line 27 and a third segment C extending from the second segment B and joining the first fold line 27.

The second deflection 37 has a first segment A extending from the second fold line 33 towards the basal section 22, a second segment B substantially parallel to the second fold line 33 and a third segment C extending from the second segment B and joining the second fold line 33.

The third deflection 72 has a first segment A extending from the first fold line 27 towards the basal section 22, a second segment B substantially parallel to the first fold line 27 and a third segment C extending from the second segment B and joining the first fold line 27.

The fourth deflection 71 has a first segment A extending from the second fold line 33 towards the basal section 22, a second segment B substantially parallel to the second fold line 33 and a third segment C extending from the second segment B and joining the second fold line 33.

Figure 7:
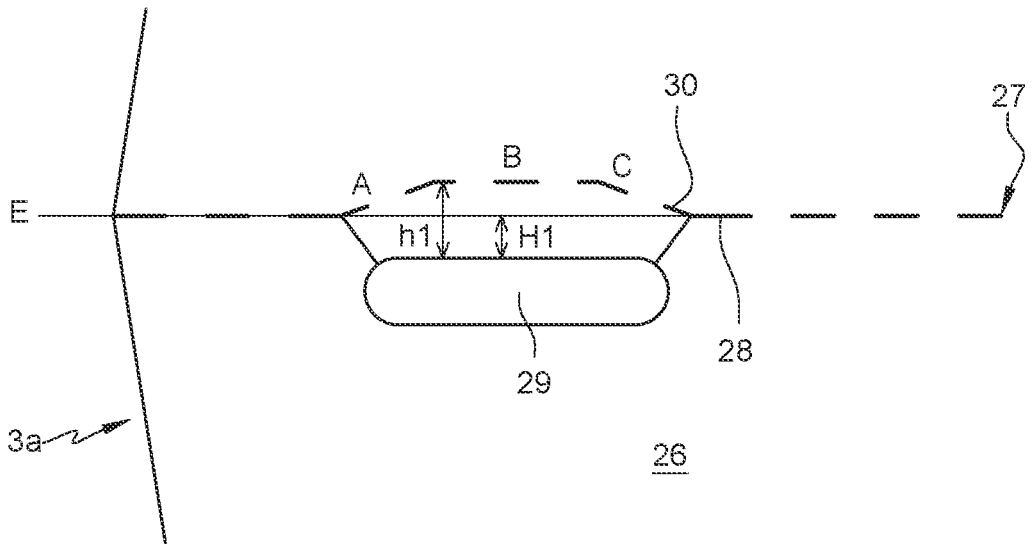
FIG. 7 is an enlarged view of a portion of FIG. 6.

As can be seen in FIG. 7, in the blank shown, said first fold line 28 has a guideline E passing through the straight portion 28 of the first fold line 27 and wherein said first recess 29 has a point closest to said guideline E, the distance between the closest point and said guideline E, measured transversally along said second section 26 of first wall 3*a* is H1 whereas the distance between the same point closest to the guideline of said first recess 29 and the furthest point of the deflection is h1 and is greater than H1.

It is to be understood that the present invention is in no way limited to the embodiments described above and that modifications may be made without departing from the scope of the appended claims.

For example, it is envisaged for the purposes of the present invention, in a particular embodiment, that all the walls extending from the basal wall comprise at least one longitudinal through hole.

In a particular embodiment, said first layer of cardboard and said second layer of cardboard of a wall are substantially identical in length.

In a particular embodiment, said first layer of cardboard and said second layer of cardboard of a wall have different lengths, for example the length of the first layer is greater than the length of the second layer, for example by a factor of 1.2, a factor of 1.5, a factor of 2 or a factor of 3.

A folding line may be made by a grooving and/or scoring and/or kiss-cutting step.

In a particular embodiment, the wall or walls that do not have a longitudinal through hole has or have a single layer of cardboard. In this embodiment, the tab sections may be located on the walls comprising one or more longitudinal through holes or on the wall section that does not have a longitudinal through hole.

In a particular embodiment, the walls are secured together by bellows. The non-recessed portions of the blank present at the intersection of the walls are folded and glued to one of the adjacent walls.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A tray comprising a cardboard base arranged to engage a lid, said base comprising a basal wall provided with at least three walls which extend predominantly upwards from the basal wall, at least a first wall and a second wall of the three walls being made of a first layer of cardboard and a second layer of cardboard, said first layer of cardboard facing the inside of the tray and said second layer of cardboard facing the outside of said tray, said second layer of said first wall and said second wall comprising at least a first longitudinal through hole and a second longitudinal through hole, respectively, said first longitudinal through hole of the first wall being delimited by the cardboard of the second layer of the first wall forming at least a top edge and a bottom edge between which the first hole is located, said top edge being positioned at a distance H1 measured from a horizontal plane passing through a straight portion of an upper edge of said first wall and along the height of said first wall and said second longitudinal through hole of the second layer of the second wall being delimited by the cardboard of the second wall forming at least a top edge and a bottom edge between which the second hole is located, said top edge being positioned at a distance H2 measured from a horizontal plane passing through a straight portion of an upper edge of said second wall and along the height of said second wall, said second layer of said first wall having a first substantially planar projection positioned above said first hole, having a height h1, measured between said top edge and a fold line predominantly forming said upper edge of said first wall, measured along the height of said projection, said height h1 being greater than said height H1, said first projection forming an angle with said first wall of less than or equal to 90° and greater than 30° arranged to retain a first embossing present on an inner surface of a first downwardly extending side wall of a cover wall of a lid, said second layer of said second wall having a second substantially planar projection, positioned above said second longitudinal through hole, having a height h2, measured between said top edge and a fold line predominantly forming said upper edge of said second wall, measured along the height of said projection, said height h2 being greater than said height H2, said second projection forming an angle with said second wall of less than or equal to 90° and greater than 30° arranged to retain a second embossing present on an inner surface of a second downwardly extending side wall of a cover wall of a lid.

2. The tray according to claim 1, wherein said basal wall provided with at least three walls is a basal wall provided with 3, 4, 6, 8, 10 or 12 walls.

3. The tray according to claim 1, wherein said basal wall is provided with 4 walls and wherein said first wall and said second wall face each other.

4. The tray according to claim 3, wherein said second layer of said first wall has a third longitudinal through hole delimited by the cardboard of the second layer of the first wall forming at least a top edge and a bottom edge between which the third hole is located, said top edge being positioned at a distance H3 measured from a horizontal plane passing through a straight portion of an upper edge of said first wall and along the height of said first wall, said second layer of said first wall having a third substantially planar projection, positioned above said third hole, having a height h3, measured between said top edge and a fold line predominantly forming said upper edge of said first wall, measured along the height of said third projection, said height h3 being greater than said height H3 said third projection forming an angle with said first wall of less than or equal to 90° and greater than 30°.

5. The tray according to claim 4, wherein said second layer of said second wall has a fourth longitudinal through hole delimited by the cardboard of the second layer of the second wall forming at least a top edge and a bottom edge between which the fourth hole is located, said top edge being positioned at a distance H4 measured from a horizontal plane passing through a straight portion of an upper edge of said second wall and along the height of said second wall, said second layer of said second wall having a fourth substantially planar projection, positioned above said fourth longitudinal through hole, having a height h4, measured between said top edge and a fold line predominantly forming said upper edge of said second wall, measured along the height of said fourth projection, said height h4 being greater than said height H4, said fourth projection forming an angle with said second wall of less than or equal to 90° and greater than 30°.

6. The tray according to claim 1, wherein said first wall and said second wall, respectively, have a first and a second length L, and wherein said first longitudinal through hole of the first wall has a first length l and said second longitudinal through hole of the second wall has a second length l, said tray being characterised in that the proportion between the first length L of said first wall and the first length l of said first longitudinal through hole present on the first wall is between 5 and 30 and in that the proportion between the second length L of said second wall and the second length l of said second longitudinal through hole present on the second wall is between 5 and 30.

7. The tray according to claim 1, wherein the upper edge of said first wall has at least a first inner deflection forming the top edge of said first projection.

8. The tray according to claim 1, wherein the upper edge of said second wall has at least a second inner deflection forming the top edge of said second projection.

9. An assembly formed by a tray according to claim 1, the assembly further comprising a lid made of a cover wall from which at least three side walls extend downwards, including the first and second side wall, said first side wall and said second side wall each having an inner surface respectively provided with a first and a second embossing projecting towards the inside of said lid arranged to fit, respectively, under the first projection of the first wall of the tray and under the second projection of the second wall of the tray.

10. The assembly according to claim 9, wherein said first embossing has a depth P1 of between 0.8 and 5 mm and wherein said second embossing has a depth P2 of between 0.8 and 5 mm.

11. A blank of a cardboard tray having a basal section provided with at least three sides, including at least a first and a second side, a first section of first wall adjacent to the basal section, along said first side, a second section of first wall adjacent to the first section of first wall, a first fold line comprising at least one straight portion, arranged to form an upper edge of said first wall of said tray, said second section of said first wall having a first longitudinal recess of length L1, arranged to form a first hole of the first wall, said first fold line further having a first deflection in said first section of first wall, the length of which is greater than the length L1, and a first section of second wall adjacent to the basal section, along said second side, a second section of second wall adjacent to the first section of second wall, a second fold line comprising at least one straight portion, arranged to form an upper edge of said second wall of said tray, said second section of said second wall having a second longitudinal recess of length L2, arranged to form a second hole of the second wall, said second fold line further having a second deflection in said first section of second wall, the length of which is greater than the length L2, said sides of said basal section being fold lines formed by grooving and/or scoring and/or kiss-cutting of the cardboard.

12. The blank according to claim 11, further comprising a first section of third wall adjacent to the basal section, along a third side, a second section of third wall adjacent to the first section of third wall, a third fold line between the first and the second section of third wall, arranged to form an upper edge of a third wall of said tray, said second section of third wall having an edge opposite the third fold line and a first and a second transverse edge facing each other, the blank further comprising a first tab section extending from said first transverse edge and a second tab section extending from said second transverse edge of the second section of the third wall, said first tab section having a linked edge and a free edge, said linked edge being connected to said first transverse edge of the second section of the third wall and forming a fold line, formed by grooving and/or scoring and/or kiss-cutting, said first tab section further having a third edge and a fourth edge, said third edge and said fourth edge being spaced apart by a distance D1 along the linked edge and by a distance D2 along the free edge, the distance D1 being greater than the distance D2, said first tab section being arranged to be introduced between the first section and the second section of the first wall, said second tab section having a linked edge and a free edge, said linked edge being connected to said second transverse edge of the second section of the third wall and forming a fold line, formed by grooving and/or scoring and/or kiss-cutting, said second tab section further having a third edge and a fourth edge, said third edge and said fourth edge being spaced apart by a distance D3 along the linked edge and by a distance D4 along the free edge, the distance D3 being greater than the distance D4, said second tab section being arranged to be introduced between the first section and the second section of the second wall.

13. The blank according to claim 12, wherein the basal section comprises 4 sides, said first and second sides being opposite each other, and comprising a fourth side opposite to the third side, said blank further comprising a first section of fourth wall adjacent to the basal section, along a fourth side, a second section of fourth wall adjacent to the first section of fourth wall, a fourth fold line between the first and the second section of fourth wall, arranged to form an upper edge of a fourth wall of said tray, said second section of fourth wall having an edge opposite the fourth fold line and a first and a second transverse edge facing each other, the blank further comprising a third tab section extending from said first transverse edge and a fourth tab section extending from said second transverse edge of the second section of the fourth wall, said third tab section having a linked edge and a free edge, said linked edge being connected to said first transverse edge of the second section of the fourth wall and forming a fold line, formed by grooving and/or scoring and/or kiss-cutting, said third tab section further having a third edge and a fourth edge, said third edge and said fourth edge being spaced apart by a distance D5 along the linked edge and by a distance D6 along the free edge, the distance D5 being greater than the distance D6, said third tab section being arranged to be introduced between the first section and the second section of the first wall, said fourth tab section having a linked edge and a free edge, said linked edge being connected to said second transverse edge of the second section of the fourth wall and forming a fold line, formed by grooving and/or scoring and/or kiss-cutting, said fourth tab section further having a third edge and a fourth edge, said third edge and said fourth edge being spaced apart by a distance D7 along the linked edge and by a distance D8 along the free edge, the distance D7 being greater than the distance D8, said fourth tab section being arranged to be introduced between the first section and the second section of the second wall.

14. The blank according to claim 11, wherein the basal section comprises 4 sides, said first and second sides being opposite each other and comprising a fourth side opposite a third side, the blank comprising a first section of third wall adjacent to the basal section, along a third side, a second section of third wall adjacent to the first section of third wall, a third fold line between the first and the second section of third wall, arranged to form an upper edge of a third wall of said tray, said second section of third wall having an edge opposite the third fold line and a first and a second transverse edge facing each other, said blank further comprising a first section of fourth wall adjacent to the basal section, along a fourth side, a second section of fourth wall adjacent to the first section of fourth wall, a fourth fold line between the first and second section of fourth wall, arranged to form an upper edge of a fourth wall of said tray, said second section of fourth wall having an edge opposite the fourth fold line and a first and second transverse edge facing each other, the blank further comprising a first section of securing means, between the first section of the first wall and the first section of the fourth wall, a second section of securing means, between the first section of the first wall and the first section of the third wall, a third section of securing means between the first section of the second wall and the first section of the fourth wall, and a fourth section of securing means, between the first section of the second wall and the first section of the third wall.

15. The blank according to claim 11, wherein said first deflection has a first segment A extending from the first fold line towards the basal section, a second segment B substantially parallel to the first fold line and a third segment C extending from the second segment B and joining the first fold line.

16. The blank according to claim 11, wherein said second deflection has a first segment A extending from the second fold line towards the basal section, a second segment B substantially parallel to the second fold line and a third segment C extending from the second segment B and joining the second fold line.

17. The blank according to claim 11, wherein said first fold line has a guideline E passing through the straight portion of the first fold line and wherein said first recess has a point closest to said guideline E, the distance between the closest point and said guideline E, measured transversally along said second section of first wall is H1, whereas the distance between the same point closest to the guideline E of said first recess and the furthest point of the deflection is h1 and is greater than H1.

18. The blank according to claim 11, wherein said second fold line has a guideline (F) passing through the straight portion of the second fold line and wherein said second recess has a point closest to said guideline (F), the distance between the closest point and said guideline (F), measured transversally along said second section of second wall, is H2, whereas the distance between the same point closest to the guideline of said second recess and the furthest point of the deflection is h2 and is greater than H2.

19. The blank according to claim 11, wherein said second section of said first wall having a third longitudinal recess of length L3, arranged to form a third hole of the first wall, said first fold line further having a third deflection in said first section of first wall, the length of which is greater than the length L3.

20. The blank according to claim 11, wherein said second section of said second wall has a fourth longitudinal recess of length L4, arranged to form a fourth hole of the second wall, said second fold line further has a fourth deflection in said first section of second wall, the length of which is greater than the length L4.

* * * * *